US010893375B2

(12) United States Patent
Breebaart et al.

(10) Patent No.: US 10,893,375 B2
(45) **Date of Patent: *Jan. 12, 2021**

(54) HEADTRACKING FOR PARAMETRIC BINAURAL OUTPUT SYSTEM AND METHOD

(71) Applicants: DOLBY INTERNATIONAL AB, Amsterdam Zuidoost (NL); Dolby Laboratories Licensing Corporation, San Francisco, CA (US)

(72) Inventors: Dirk Jeroen Breebaart, Ultimo (AU); David Matthew Cooper, Carlton (AU); Mark F. Davis, Pacifica, CA (US); David S. McGrath, Rose Bay (AU); Kristofer Kjoerling, Solna (SE); Harald Mundt, Fürth (DE); Rhonda J. Wilson, San Francisco, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/516,121

(22) Filed: Jul. 18, 2019

(65) Prior Publication Data

US 2019/0342694 A1 Nov. 7, 2019

Related U.S. Application Data

(63) Continuation of application No. 15/777,058, filed as application No. PCT/US2016/062497 on Nov. 17, 2016, now Pat. No. 10,362,431.

(Continued)

(30) Foreign Application Priority Data

Dec. 14, 2015 (EP) ..... 15199854

(51) Int. Cl.
*H04S 7/00* (2006.01)
*G10L 19/008* (2013.01)

(Continued)

(52) U.S. Cl.
CPC ..... *H04S 7/304* (2013.01); *G10L 19/008* (2013.01); *H04R 5/033* (2013.01); *H04S 3/004* (2013.01);

(Continued)

(58) Field of Classification Search
CPC ..... H04S 7/304; H04S 7/306; H04S 3/008; H04S 2400/11; H04S 2420/01;

(Continued)

(56) References Cited

U.S. PATENT DOCUMENTS 6,108,430 A 8/2000 Kurisu
6,718,042 B1 4/2004 McGrath (Continued)

FOREIGN PATENT DOCUMENTS

CN 101889307 11/2010
CN 104854655 8/2015

(Continued)

OTHER PUBLICATIONS

Allison, R.S. "Tolerance of Temporal Delay in Virtual Environments" Proc. of IEEE Virtual Reality, Mar. 13-17, 2001, pp. 1-8.

(Continued)

*Primary Examiner* — Jason R Kurr

(57) ABSTRACT

A method of encoding channel or object based input audio for playback, the method including the steps of: (a) initially rendering the channel or object based input audio into an initial output presentation; (b) determining an estimate of the dominant audio component from the channel or object based input audio and determining a series of dominant audio component weighting factors for mapping the initial output (Continued)

presentation into the dominant audio component; (c) determining an estimate of the dominant audio component direction or position; and (d) encoding the initial output presentation, the dominant audio component weighting factors, the dominant audio component direction or position as the encoded signal for playback.

13 Claims, 5 Drawing Sheets

Related U.S. Application Data

(60) Provisional application No. 62/256,462, filed on Nov. 17, 2015.

(51) Int. Cl.
*H04S 3/00* (2006.01)
*H04R 5/033* (2006.01)

(52) U.S. Cl.
CPC ..... *H04S 3/008* (2013.01); *H04S 2400/01* (2013.01); *H04S 2400/11* (2013.01); *H04S 2420/01* (2013.01); *H04S 2420/03* (2013.01)

(58) Field of Classification Search
CPC .. H04S 2420/03; H04S 3/004; H04S 2400/01; H04R 5/033; G10L 19/008
USPC ..... 381/22, 23
See application file for complete search history.

(56) References Cited

U.S. PATENT DOCUMENTS

| | | | |
|---|---|---|---|
| 6,839,438 | B1 | 1/2005 | Riegelsberger |
| 7,502,477 | B1 | 3/2009 | Inanaga |
| 7,536,021 | B2 | 5/2009 | Dickins |
| 7,603,080 | B2 | 10/2009 | Richenstein |
| 7,660,424 | B2 | 2/2010 | Davis |
| 7,876,903 | B2 | 1/2011 | Sauk |
| 8,081,762 | B2 | 12/2011 | Ojala |
| 8,325,941 | B2 | 12/2012 | Hooley |
| 8,364,497 | B2 | 1/2013 | Beack et al. |
| 8,379,868 | B2 | 2/2013 | Goodwin |
| 8,587,631 | B2 | 11/2013 | Etter |
| 9,933,989 | B2 | 4/2018 | Tsingos |
| 2006/0045294 | A1 | 3/2006 | Smyth |
| 2009/0052703 | A1 | 2/2009 | Hammershoi |
| 2011/0116638 | A1 | 5/2011 | Son |
| 2012/0093320 | A1 | 4/2012 | Flaks |
| 2012/0128160 | A1 | 5/2012 | Kim |
| 2015/0098572 | A1 | 4/2015 | Kruger |
| 2015/0332679 | A1 | 11/2015 | Krueger |
| 2016/0227337 | A1 | 8/2016 | Goodwin |

FOREIGN PATENT DOCUMENTS

| | | |
|---|---|---|
| EP | 1070438 | 1/2001 |
| EP | 2137725 | 8/2014 |
| JP | 2006270649 | 10/2006 |
| RU | 2430430 | 9/2011 |
| WO | 2014053875 | 4/2014 |
| WO | 2014191798 | 12/2014 |
| WO | 2017035281 | 3/2017 |

OTHER PUBLICATIONS

Breebaart, J. et al "MPEG Surround Binaural Coding Proposal Philips/VAST Audio", 76 MPEG Meeting; Apr. 2006, (Motion Pictureexpert Group or No. M13253, pp. 1-50.

Breebaart, J. et al. "Multi-Channel Goes Mobile: MPEG Surround Binaural Rendering", Conference: 29th International Conference; Audio for Mobile and Handheld Devices ,AES, 60 East 42nd Street, Room 2520 New York, Sep. 1, 2006.

Gundry, Kenneth "A New Active Matrix Decoder for Surround Sound" 19th International Conference: Surround Sound—Techniques, Technology, and Perception, Jun. 1, 2001.

ISO/IEC 14496-3:2009—Information Technology—"Coding of Audio-Visual Objects—Part 3: Audio" 2009.

Laitinen, Mlkko-Ville et al "Binaural reproduction for Directional Audio Coding", IEEE Workshop on Applications of Signal Processing to Audio and Acoustics, Oct. 18-21, 2009, pp. 337-340.

Mania, K. et al "Perceptual Sensitivity to Head Tracking Latency in Virtual Environments with Varying Degrees of Scene Complexity" Proc. of the 1st Symposium on Applied Perception in Graphics and Visualization, pp. 39-47, Aug. 7-8, 2004.

Van de Par, S. et al "Sensitivity to Auditory-Visual Asynchrony and to Jitter in Auditory-Visual Timing" Electronic Imaging International Society for Optics and Photonics, Jun. 2, 2000, pp. 234-242.

Vinton, M. et al "Next Generation Surround Decoding and Upmixing for Consumer and Professional Applications" 57th International Conference: The Future of Audio Entertainment Technoogy—Cinema, Television and the Internet, Mar. 6, 2015.

Wightman, F. et al "Headphone Simulation of Free-Field Listening. I:Stimulus Synthesis" J. Acoust. Soc. Am. 85, pp. 858-867.

HEADTRACKING FOR PARAMETRIC BINAURAL OUTPUT SYSTEM AND METHOD

FIELD OF THE INVENTION

The present invention provides for systems and methods for the improved form of parametric binaural output when optionally utilizing headtracking.

REFERENCES

Gundry, K., "A New Matrix Decoder for Surround Sound," AES 19th International Conf., Schloss Elmau, Germany, 2001.

Vinton, M., McGrath, D., Robinson, C., Brown, P., "Next generation surround decoding and up-mixing for consumer and professional applications", AES 57th International Conf, Hollywood, Calif., USA, 2015.

Wightman, F. L., and Kistler, D. J. (1989). "Headphone simulation of free-field listening. I. Stimulus synthesis," J. Acoust. Soc. Am. 85, 858-867.

ISO/IEC 14496-3:2009—Information technology—Coding of audio-visual objects—Part 3: Audio, 2009.

Mania, Katerina, et al. "Perceptual sensitivity to head tracking latency in virtual environments with varying degrees of scene complexity." Proceedings of the 1st Symposium on Applied perception in graphics and visualization. ACM, 2004.

Allison, R. S., Harris, L. R., Jenkin, M., Jasiobedzka, U., & Zacher, J. E. (2001, March). Tolerance of temporal delay in virtual environments. In Virtual Reality, 2001. Proceedings. IEEE (pp. 247-254). IEEE.

Van de Par, Steven, and Armin Kohlrausch. "Sensitivity to auditory-visual asynchrony and to jitter in auditory-visual timing." Electronic Imaging. International Society for Optics and Photonics, 2000.

BACKGROUND OF THE INVENTION

Any discussion of the background art throughout the specification should in no way be considered as an admission that such art is widely known or forms part of common general knowledge in the field.

The content creation, coding, distribution and reproduction of audio content is traditionally channel based. That is, one specific target playback system is envisioned for content throughout the content ecosystem. Examples of such target playback systems are mono, stereo, 5.1, 7.1, 7.1.4, and the like.

If content is to be reproduced on a different playback system than the intended one, down-mixing or up-mixing can be applied. For example, 5.1 content can be reproduced over a stereo playback system by employing specific known down-mix equations. Another example is playback of stereo content over a 7.1 speaker setup, which may comprise a so-called up-mixing process that could or could not be guided by information present in the stereo signal such as used by so-called matrix encoders such as Dolby Pro Logic. To guide the up-mixing process, information on the original position of signals before down-mixing can be signaled implicitly by including specific phase relations in the down-mix equations, or said differently, by applying complex-valued down-mix equations. A well-known example of such down-mix method using complex-valued down-mix coefficients for content with speakers placed in two dimensions is LtRt (Vinton et al. 2015).

The resulting (stereo) down-mix signal can be reproduced over a stereo loudspeaker system, or can be up-mixed to loudspeaker setups with surround and/or height speakers. The intended location of the signal can be derived by an up-mixer from the inter-channel phase relationships. For example, in an LtRt stereo representation, a signal that is out-of-phase (e.g., has an inter-channel waveform normalized cross-correlation coefficient close to −1) should ideally be reproduced by one or more surround speakers, while a positive correlation coefficient (close to +1) indicates that the signal should be reproduced by speakers in front of the listener.

A variety of up-mixing algorithms and strategies have been developed that differ in their strategies to recreate a multi-channel signal from the stereo down-mix. In relatively simple up-mixers, the normalized cross-correlation coefficient of the stereo waveform signals is tracked as a function of time, while the signal(s) are steered to the front or rear speakers depending on the value of the normalized cross-correlation coefficient. This approach works well for relatively simple content in which only one auditory object is present simultaneously. More advanced up-mixers are based on statistical information that is derived from specific frequency regions to control the signal flow from stereo input to multi-channel output (Gundry 2001, Vinton et al. 2015). Specifically, a signal model based on a steered or dominant component and a stereo (diffuse) residual signal can be employed in individual time/frequency tiles. Besides estimation of the dominant component and residual signals, a direction (in azimuth, possibly augmented with elevation) angle is estimated as well, and subsequently the dominant component signal is steered to one or more loudspeakers to reconstruct the (estimated) position during playback.

The use of matrix encoders and decoders/up-mixers is not limited to channel-based content. Recent developments in the audio industry are based on audio objects rather than channels, in which one or more objects consist of an audio signal and associated metadata indicating, among other things, its intended position as a function of time. For such object-based audio content, matrix encoders can be used as well, as outlined in Vinton et al. 2015. In such a system, object signals are down-mixed into a stereo signal representation with down-mix coefficients that are dependent on the object positional metadata.

The up-mixing and reproduction of matrix-encoded content is not necessarily limited to playback on loudspeakers. The representation of a steered or dominant component consisting of a dominant component signal and (intended) position allows reproduction on headphones by means of convolution with head-related impulse responses (HRIRs) (Wightman et al, 1989). A simple schematic of a system implementing this method is shown 1 in FIG. 1. The input signal 2, in a matrix encoded format, is first analyzed 3 to determine a dominant component direction and magnitude. The dominant component signal is convolved 4, 5 by means of a pair of HRIRs derived from a lookup 6 based on the dominant component direction, to compute an output signal for headphone playback 7 such that the play back signal is perceived as coming from the direction that was determined by the dominant component analysis stage 3. This scheme can be applied on wide-band signals as well as on individual subbands, and can be augmented with dedicated processing of residual (or diffuse) signals in various ways.

The use of matrix encoders is very suitable for distribution to and reproduction on AV receivers, but can be problematic for mobile applications requiring low transmission data rates and low power consumption.

Irrespective of whether channel or object-based content is used, matrix encoders and decoders rely on fairly accurate inter-channel phase relationships of the signals that are distributed from matrix encoder to decoder. In other words, the distribution format should be largely waveform preserving. Such dependency on waveform preservation can be problematic in bit-rate constrained conditions, in which audio codecs employ parametric methods rather than waveform coding tools to obtain a better audio quality. Examples of such parametric tools that are generally known not to be waveform preserving are often referred to as spectral band replication, parametric stereo, spatial audio coding, and the like as implemented in MPEG-4 audio codecs (ISO/IEC 14496-3:2009).

As outlined in the previous section, the up-mixer consists of analysis and steering (or HRIR convolution) of signals. For powered devices, such as AV receivers, this generally does not cause problems, but for battery-operated devices such as mobile phones and tablets, the computational complexity and corresponding memory requirements associated with these processes are often undesirable because of their negative impact on battery life.

The aforementioned analysis typically also introduces additional audio latency. Such audio latency is undesirable because (1) it requires video delays to maintain audio-video lip sync requiring a significant amount of memory and processing power, and (2) may cause asynchrony/latency between head movements and audio rendering in the case of head tracking.

The matrix-encoded down-mix may also not sound optimal on stereo loudspeakers or headphones, due to the potential presence of strong out-of-phase signal components.

SUMMARY OF THE INVENTION

It is an object of the invention, to provide an improved form of parametric binaural output.

In accordance with a first aspect of the present invention, there is provided a method of encoding channel or object based input audio for playback, the method including the steps of: (a) initially rendering the channel or object based input audio into an initial output presentation (e.g., initial output representation); (b) determining an estimate of the dominant audio component from the channel or object based input audio and determining a series of dominant audio component weighting factors for mapping the initial output presentation into the dominant audio component; (c) determining an estimate of the dominant audio component direction or position; and (d) encoding the initial output presentation, the dominant audio component weighting factors, the dominant audio component direction or position as the encoded signal for playback. Providing the series of dominant audio component weighting factors for mapping the initial output presentation into the dominant audio component may enable utilizing the dominant audio component weighting factors and the initial output presentation to determine the estimate of the dominant component.

In some embodiments, the method further includes determining an estimate of a residual mix being the initial output presentation less a rendering of either the dominant audio component or the estimate thereof. The method can also include generating an anechoic binaural mix of the channel or object based input audio, and determining an estimate of a residual mix, wherein the estimate of the residual mix can be the anechoic binaural mix less a rendering of either the dominant audio component or the estimate thereof. Further, the method can include determining a series of residual matrix coefficients for mapping the initial output presentation to the estimate of the residual mix.

The initial output presentation can comprise a headphone or loudspeaker presentation. The channel or object based input audio can be time and frequency tiled and the encoding step can be repeated for a series of time steps and a series of frequency bands. The initial output presentation can comprise a stereo speaker mix.

In accordance with a further aspect of the present invention, there is provided a method of decoding an encoded audio signal, the encoded audio signal including: a first (e.g., initial) output presentation (e.g., first/initial output representation); —a dominant audio component direction and dominant audio component weighting factors; the method comprising the steps of: (a) utilizing the dominant audio component weighting factors and initial output presentation to determine an estimated dominant component; (b) rendering the estimated dominant component with a binauralization at a spatial location relative to an intended listener in accordance with the dominant audio component direction to form a rendered binauralized estimated dominant component; (c) reconstructing a residual component estimate from the first (e.g., initial) output presentation; and (d) combining the rendered binauralized estimated dominant component and the residual component estimate to form an output spatialized audio encoded signal.

The encoded audio signal further can include a series of residual matrix coefficients representing a residual audio signal and the step (c) further can comprise (c1) applying the residual matrix coefficients to the first (e.g., initial) output presentation to reconstruct the residual component estimate.

In some embodiments, the residual component estimate can be reconstructed by subtracting the rendered binauralized estimated dominant component from the first (e.g., initial) output presentation. The step (b) can include an initial rotation of the estimated dominant component in accordance with an input headtracking signal indicating the head orientation of an intended listener.

In accordance with a further aspect of the present invention, there is provided a method for decoding and reproduction of an audio stream for a listener using headphones, the method comprising: (a) receiving a data stream containing a first audio representation and additional audio transformation data; (b) receiving head orientation data representing the orientation of the listener; (c) creating one or more auxiliary signal(s) based on the first audio representation and received transformation data; (d) creating a second audio representation consisting of a combination of the first audio representation and the auxiliary signal(s), in which one or more of the auxiliary signal(s) have been modified in response to the head orientation data; and (e) outputting the second audio representation as an output audio stream.

In some embodiments can further include the modification of the auxiliary signals consists of a simulation of the acoustic pathway from a sound source position to the ears of the listener. The transformation data can consist of matrixing coefficients and at least one of: a sound source position or sound source direction. The transformation process can be applied as a function of time or frequency. The auxiliary signals can represent at least one dominant component. The sound source position or direction can be received as part of the transformation data and can be rotated in response to the head orientation data. In some embodiments, the maximum amount of rotation is limited to a value less than 360 degrees in azimuth or elevation. The secondary representation can be obtained from the first representation by matrixing in a transform or filterbank domain. The transformation data further can comprise additional matrixing coefficients, and step (d) further can comprise modifying the first audio presentation in response to the additional matrixing coefficients prior to combining the first audio presentation and the auxiliary audio signal(s).

BRIEF DESCRIPTION OF THE DRAWINGS

Embodiments of the invention will now be described, by way of example only, with reference to the accompanying drawings in which.

DETAILED DESCRIPTION

Embodiments provide a system and method to represent object or channel based audio content that is (1) compatible with stereo playback, (2) allows for binaural playback including head tracking, (3) is of a low decoder complexity, and (4) does not rely on but is nevertheless compatible with matrix encoding.

This is achieved by combining encoder-side analysis of one or more dominant components (or dominant object or combination thereof) including weights to predict these dominant components from a down-mix, in combination with additional parameters that minimize the error between a binaural rendering based on the steered or dominant components alone, and the desired binaural presentation of the complete content.

In an embodiment an analysis of the dominant component (or multiple dominant components) is provided in the encoder rather than the decoder/renderer. The audio stream is then augmented with metadata indicating the direction of the dominant component, and information as to how the dominant component(s) can be obtained from an associated down-mix signal.

Figure 1:
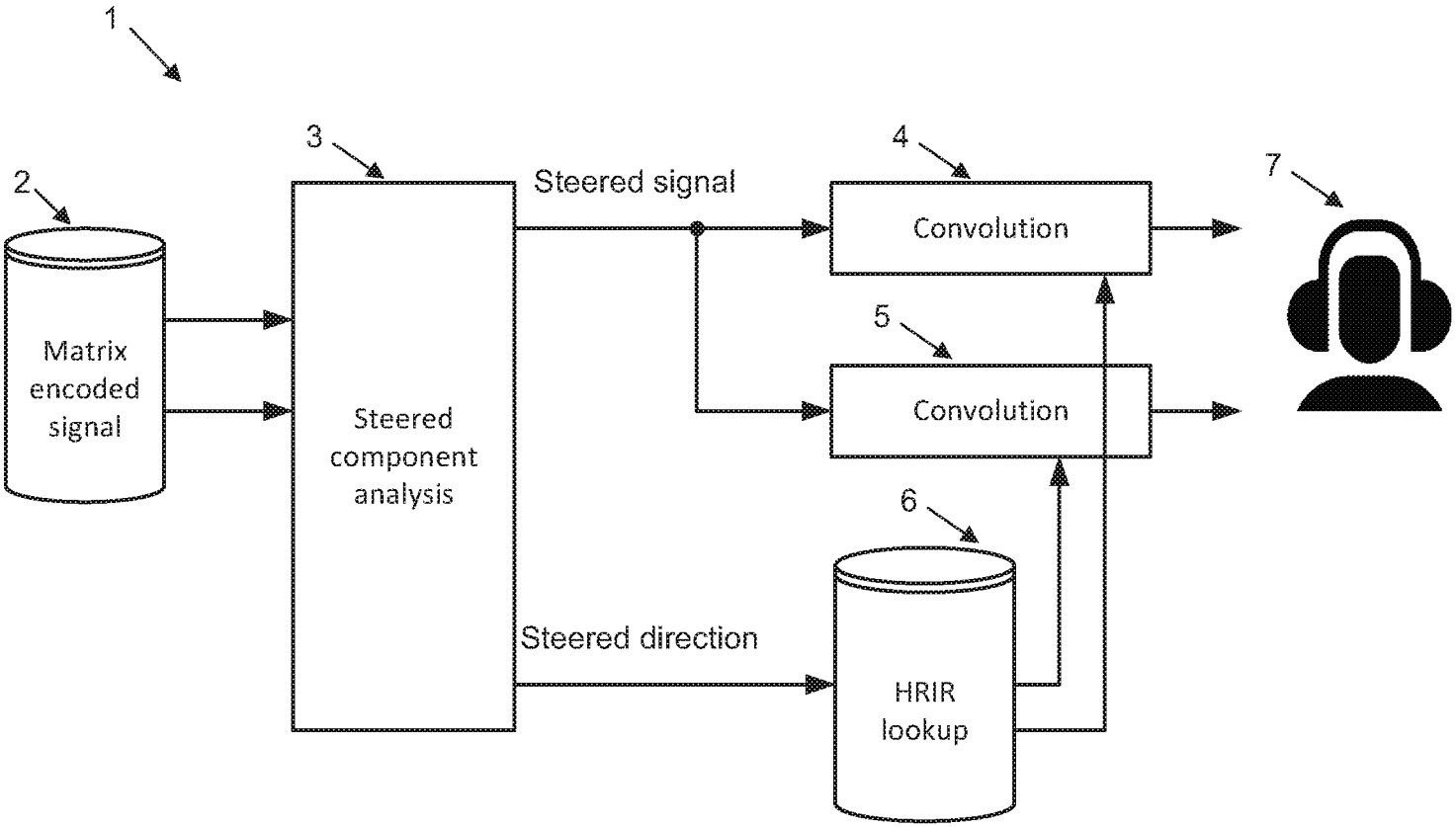
FIG. 1 PRIOR ART
FIG. 1 illustrates schematically a headphone decoder for matrix-encoded content.
Figure 2:
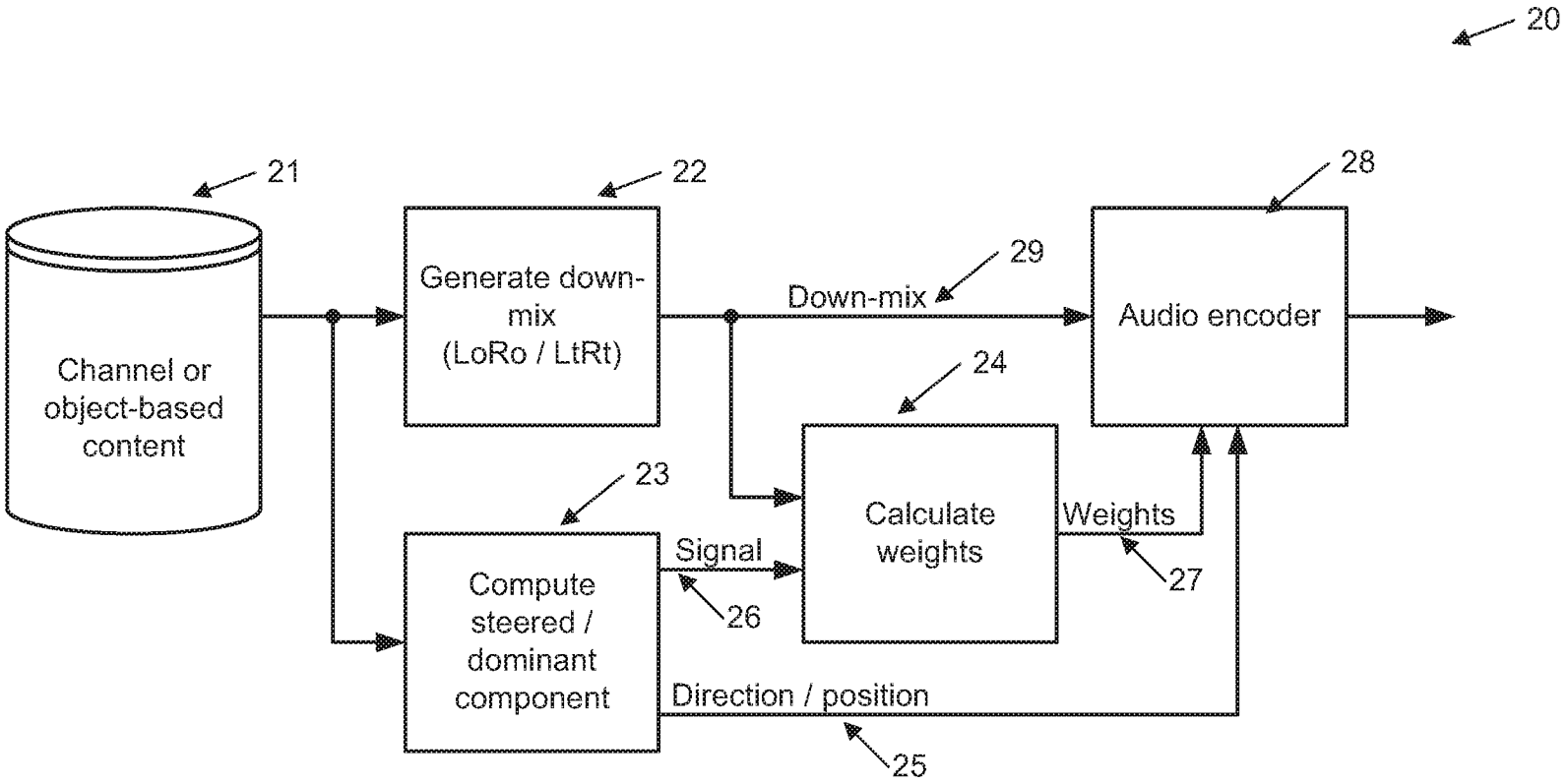
FIG. 2 illustrates schematically an encoder according to an embodiment.

FIG. 2 illustrates one form of an encoder 20 of the preferred embodiment. Object or channel-based content 21 is subjected to an analysis 23 to determine a dominant component(s). This analysis may take place as a function of time and frequency (assuming the audio content is broken up into time tiles and frequency subtiles). The result of this process is a dominant component signal 26 (or multiple dominant component signals), and associated position(s) or direction(s) information 25. Subsequently, weights are estimated 24 and output 27 to allow reconstruction of the dominant component signal(s) from a transmitted down-mix. This down-mix generator 22 does not necessarily have to adhere to LtRt down-mix rules, but could be a standard ITU (LoRo) down-mix using non-negative, real-valued down-mix coefficients. Lastly, the output down-mix signal 29, the weights 27, and the position data 25 are packaged by an audio encoder 28 and prepared for distribution.

Figure 3:
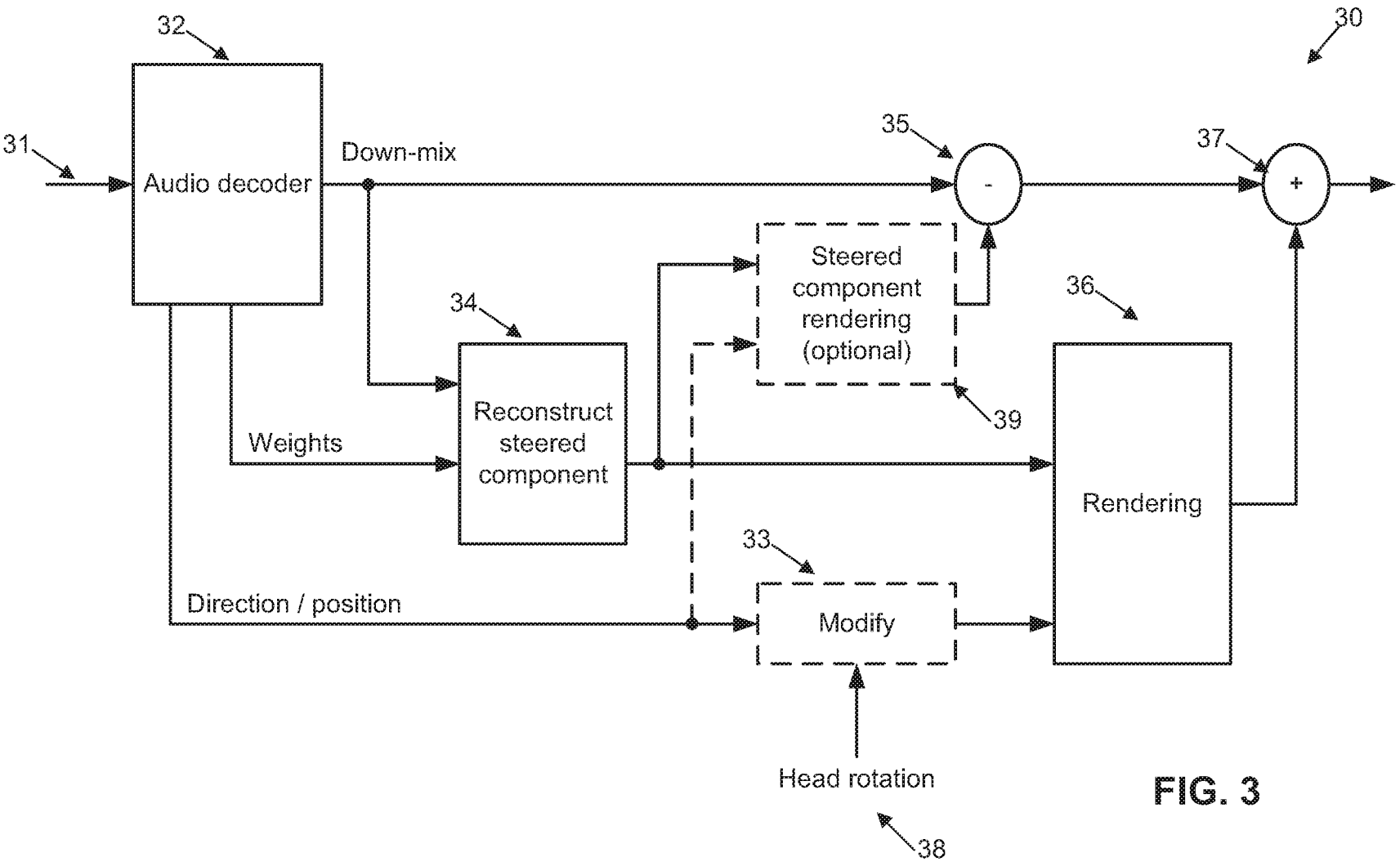
FIG. 3 is a schematic block diagram of the decoder.

Turning now to FIG. 3, there is illustrated a corresponding decoder 30 of the preferred embodiment. The audio decoder reconstructs the down-mix signal. The signal is input 31 and unpacked by the audio decoder 32 into down-mix signal, weights and direction of the dominant components. Subsequently, the dominant component estimation weights are used to reconstruct 34 the steered component(s), which are rendered 36 using transmitted position or direction data. The position data may optionally be modified 33 dependent on head rotation or translation information 38. Additionally, the reconstructed dominant component(s) may be subtracted 35 from the down-mix. Optionally, there is a subtraction of the dominant component(s) within the down-mix path, but alternatively, this subtraction may also occur at the encoder, as described below.

In order to improve removal or cancellation of the reconstructed dominant component in subtractor 35, the dominant component output may first be rendered using the transmitted position or direction data prior to subtraction. This optional rendering stage 39 is shown in FIG. 3.

Figure 4:
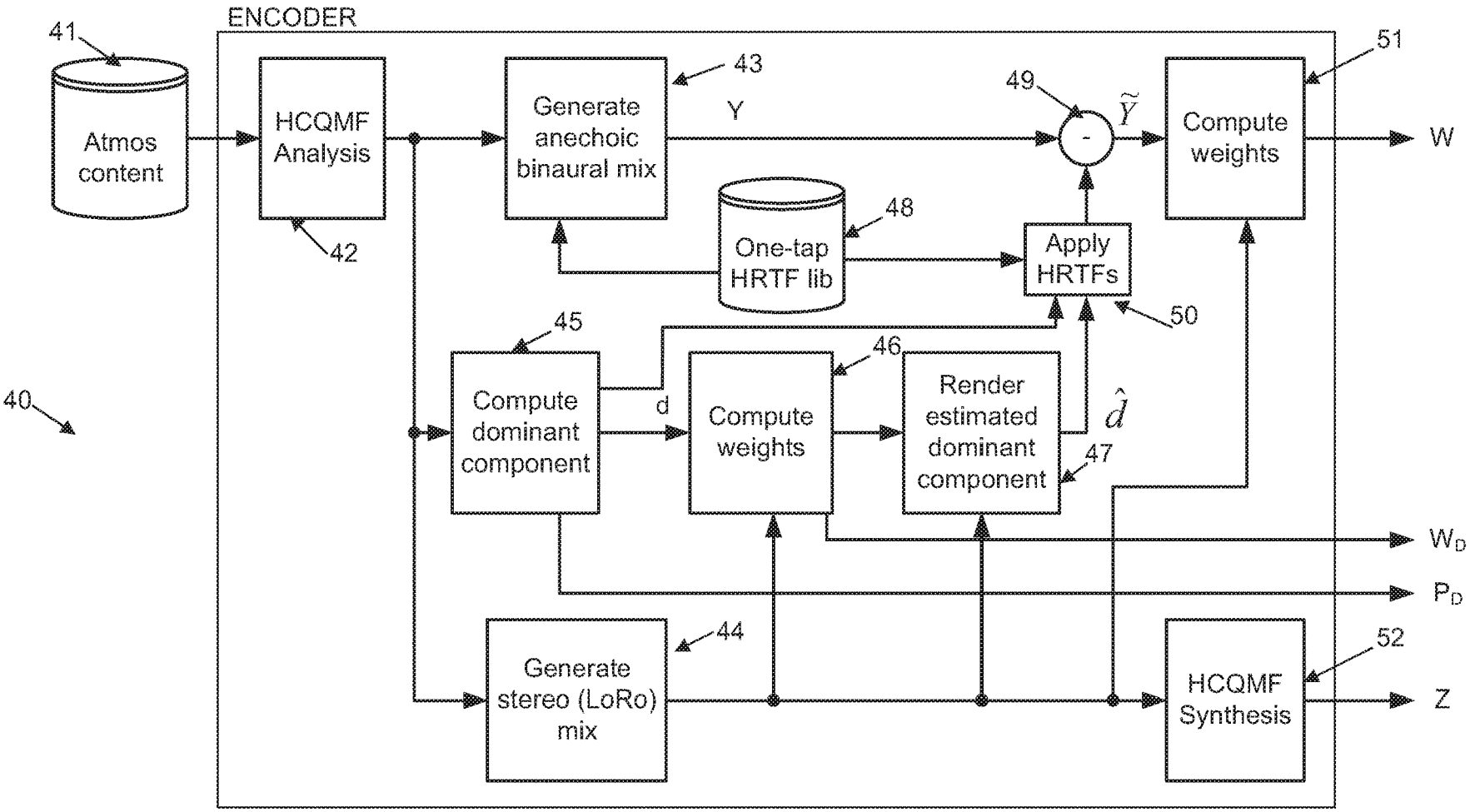
FIG. 4 is a detailed visualization of an encoder.

Returning now to initially describe the encoder in more detail, FIG. 4 shows one form of encoder 40 for processing object-based (e.g. Dolby Atmos) audio content. The audio objects are originally stored as Atmos objects 41 and are initially split into time and frequency tiles using a hybrid complex-valued quadrature mirror filter (HCQMF) bank 42. The input object signals can be denoted by $x_i[n]$ when we omit the corresponding time and frequency indices; the corresponding position within the current frame is given by unit vector $\vec{p}_i$, and index i refers to the object number, and index n refers to time (e.g., sub band sample index). The input object signals $x_i[n]$ are an example for channel or object based input audio.

An anechoic, sub band, binaural mix Y ($y_l$, $y_r$) is created 43 using complex-valued scalars $H_{l,i}$, $H_{r,i}$ (e.g., one-tap HRTFs 48) that represent the sub-band representation of the HRIRs corresponding to position $\vec{p}_i$:

$$y_l[n] = \sum_i H_{l,i} x_i[n]$$

$$y_r[n] = \sum_i H_{r,i} x_i[n]$$

Alternatively, the binaural mix Y ($y_l$, $y_r$) may be created by convolution using head-related impulse responses (HRIRs). Additionally, a stereo down-mix $z_l$, $z_r$ (exemplarily embodying an initial output presentation) is created 44 using amplitude-panning gain coefficients $g_{l,i}$, $g_{r,i}$:

$$z_l[n] = \sum_i g_{l,i} x_i[n]$$

$$z_r[n] = \sum_i g_{r,i} x_i[n]$$

The direction vector of the dominant component $\vec{p}_D$ (exemplarily embodying a dominant audio component direction or position) can be estimated by computing the dominant component 45 by initially calculating a weighted sum of unit direction vectors for each object:

$$\vec{p}_D = \frac{\sum_i \sigma_i^2 \vec{p}_i}{\sum_i \sigma_i^2}$$

with $\sigma_i^2$ the energy of signal $x_i[n]$:

$$\sigma_i^2 = \sum_n x_i[n]x_i^*[n]$$

and with (.)* being the complex conjugation operator.

The dominant/steered signal, d[n] (exemplarily embodying a dominant audio component) is subsequently given by:

$$d[n] = \sum_i x_i[n]\mathcal{F}(\vec{p}_D, \vec{p}_i)$$

with $\mathcal{F}(\vec{p}_1, \vec{p}_2)$ a function that produces a gain that decreases with increasing distance between unit vectors $\vec{p}_1$, $\vec{p}_2$. For example, to create a virtual microphone with a directionality pattern based on higher-order spherical harmonics, one implementation would correspond to:

$$\mathcal{F}(\vec{p}_1, \vec{p}_2) = (a + b\vec{p}_1^{\,T} \cdot \vec{p}_2)^c$$

with $\vec{p}_i$ representing a unit direction vector in a two or three-dimensional coordinate system, (.) the dot product operator for two vectors, and with a, b, c exemplary parameters (for example a=b=0.5; c=1).

The weights or prediction coefficients $w_{l,d}$, $w_{r,d}$ are calculated 46 and used to compute 47 an estimated steered signal $\hat{d}[n]$:

$$\hat{d}[n] = w_{l,d}z_l + w_{r,d}z_r$$

with weights $w_{l,d}$, $w_{r,d}$ minimizing the mean square error between d[n] and $\hat{d}[n]$ given the down-mix signals $z_l$, $z_r$. The weights $w_{l,d}$, $w_{r,d}$ are an example for dominant audio component weighting factors for mapping the initial output presentation (e.g., $z_l$, $z_r$) to the dominant audio component (e.g., $\hat{d}[n]$). A known method to derive these weights is by applying a minimum mean-square error (MMSE) predictor:

$$\begin{bmatrix} w_{l,d} \\ w_{r,d} \end{bmatrix} = (R_{zz} + \epsilon I)^{-1} R_{zd}$$

with $R_{ab}$ the covariance matrix between signals for signals a and signals b, and $\in$ a regularization parameter.

We can subsequently subtract 49 the rendered estimate of the dominant component signal $\hat{d}[n]$ from the anechoic binaural mix $y_l$, $y_r$ to create a residual binaural mix $\tilde{y}_l$, $\tilde{y}_r$ using HRTFs (HRIRs) $H_{l,D}$, $H_{r,D}$ 50 associated with the direction/position $\vec{p}_D$ of the dominant component signal $\hat{d}$:

$$\tilde{y}_l[n] = y_l[n] - H_{l,D}\hat{d}[n]$$

$$\tilde{r}_l[n] = y_r[n] - H_{r,D}\hat{d}[n]$$

Last, another set of prediction coefficients or weights $w_{i,j}$ is estimated 51 that allow reconstruction of the residual binaural mix $\tilde{y}_l$, $\tilde{y}_r$ from the stereo mix $z_l$, $z_r$ using minimum mean square error estimates:

$$\begin{bmatrix} w_{1,1} & w_{1,2} \\ w_{2,1} & w_{2,2} \end{bmatrix} = (R_{zz} + \epsilon I)^{-1} R_{z\tilde{y}}$$

with $R_{ab}$ the covariance matrix between signals for representation a and representation b, and $\in$ a regularization parameter. The prediction coefficients or weights $w_{i,j}$ are an example of residual matrix coefficients for mapping the initial output presentation (e.g., $z_l$, $z_r$) to the estimate of the residual binaural mix $\tilde{y}_l$, $\tilde{y}_r$. The above expression may be subjected to additional level constraints to overcome any prediction losses. The encoder outputs the following information:

The stereo mix $z_l$, $z_r$ (exemplarily embodying the initial output presentation);

The coefficients to estimate the dominant component $w_{l,d}$, $w_{r,d}$ (exemplarily embodying the dominant audio component weighting factors);

The position or direction of the dominant component $\vec{p}_D$;

And optionally, the residual weights $w_{i,j}$ (exemplarily embodying the residual matrix coefficients).

Although the above description relates to rendering based on a single dominant component, in some embodiments the encoder may be adapted to detect multiple dominant components, determine weights and directions for each of the multiple dominant components, render and subtract each of the multiple dominant components from anechoic binaural mix Y, and then determine the residual weights after each of the multiple dominant components has been subtracted from the anechoic binaural mix Y.

Decoder/Renderer

Figure 5:
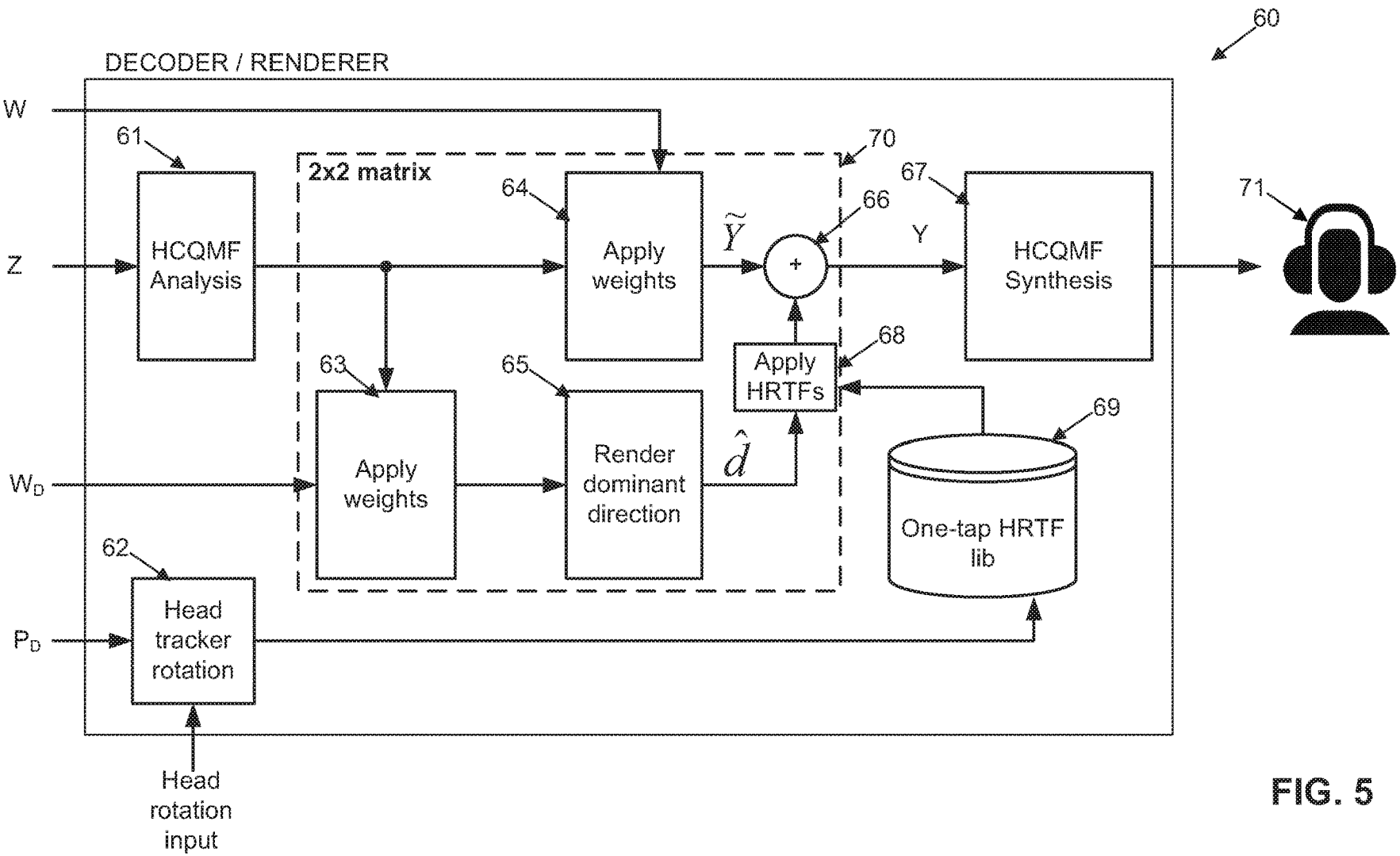
FIG. 5 illustrates one form of the decoder in more detail.

FIG. 5 illustrates one form of decoder/renderer 60 in more detail. The decoder/renderer 60 applies a process aiming at reconstructing the binaural mix $y_l$, $y_r$ for output to listener 71 from the unpacked input information $z_l$, $z_r$; $w_{l,d}$, $w_{r,d}$; $\vec{p}_D$; $w_{i,j}$. Here, the stereo mix $z_l$, $z_r$ is an example of a first audio representation, and the prediction coefficients or weights $w_{i,j}$ and/or the direction/position $\vec{p}_D$ of the dominant component signal $\hat{d}$ are examples of additional audio transformation data.

Initially, the stereo down-mix is split into time/frequency tiles using a suitable filterbank or transform 61, such as the HCQMF analysis bank 61. Other transforms such as a discrete Fourier transform, (modified) cosine or sine transform, time-domain filterbank, or wavelet transforms may equally be applied as well. Subsequently, the estimated dominant component signal $\hat{d}[n]$ is computed 63 using prediction coefficient weights $w_{l,d}$, $w_{r,d}$;

$$\hat{d}[n] = w_{l,d}z_l + w_{r,d}z_r$$

The estimated dominant component signal $\hat{d}[n]$ is an example of an auxiliary signal. Hence, this step may be said to correspond to creating one or more auxiliary signal(s) based on said first audio representation and received transformation data.

This dominant component signal is subsequently rendered 65 and modified 68 with HRTFs 69 based on the transmitted position/direction data $\vec{p}_D$, possibly modified (rotated) based on information obtained from a head tracker 62. Finally, the total anechoic binaural output consists of the rendered dominant component signal summed 66 with the reconstructed residuals $\tilde{y}_l$, $\tilde{y}_r$ based on prediction coefficient weights $w_{i,j}$:

$$\begin{bmatrix} \tilde{y}_l \\ \tilde{y}_r \end{bmatrix} = \left( \begin{bmatrix} w_{1,1} & w_{1,2} \\ w_{2,1} & w_{2,2} \end{bmatrix} \right) \begin{bmatrix} z_l \\ z_r \end{bmatrix}$$

-continued $$\begin{bmatrix} \hat{y}_l \\ \hat{y}_r \end{bmatrix} = \left( \begin{bmatrix} w_{1,1} & w_{1,2} \\ w_{2,1} & w_{2,2} \end{bmatrix} + \begin{bmatrix} H_{l,D} \\ H_{r,D} \end{bmatrix} [\, w_{l,d} \quad w_{r,d} \,] \right) \begin{bmatrix} z_l \\ z_r \end{bmatrix}$$

The total anechoic binaural output is an example of a second audio representation. Hence, this step may be said to correspond to creating a second audio representation consisting of a combination of said first audio representation and said auxiliary signal(s), in which one or more of said auxiliary signal(s) have been modified in response to said head orientation data.

It should be further noted, that if information on more than one dominant signal is received, each dominant signal may be rendered and added to the reconstructed residual signal.

As long as no head rotation or translation is applied, the output signals $\hat{y}_l$, $\hat{y}_r$ should be very close (in terms of root-mean-square error) to the reference binaural signals $y_l$, $y_r$ as long as $$\hat{d}[n] \approx d[n]$$

Key Properties

As can be observed from the above equation formulation, the effective operation to construct the anechoic binaural presentation from the stereo presentation consists of a 2×2 matrix 70, in which the matrix coefficients are dependent on transmitted information $w_{l,d}$, $W_{r,d}$; $\vec{p}_D$; $w_{i,j}$ and head tracker rotation and/or translation. This indicates that the complexity of the process is relatively low, as analysis of the dominant components is applied in the encoder instead of in the decoder.

If no dominant component is estimated (e.g., $W_{l,d}$, $w_{r,d}=0$), the described solution is equivalent to a parametric binaural method.

In cases where there is a desire to exclude certain objects from head rotation/head tracking, these objects can be excluded from (1) dominant component direction analysis, and (2) dominant component signal prediction. As a result, these objects will be converted from stereo to binaural through the coefficients $w_{i,j}$ and therefore not be affected by any head rotation or translation.

In a similar line of thinking, objects can be set to a 'pass through' mode, which means that in the binaural presentation, they will be subjected to amplitude panning rather than HRIR convolution. This can be obtained by simply using amplitude-panning gains for the coefficients $H_{,i}$ instead of the one-tap HRTFs or any other suitable binaural processing.

Extensions

The embodiments are not limited to the use of stereo down-mixes, as other channel counts can be employed as well.

The decoder 60 described with reference to FIG. 5 has an output signal that consists of a rendered dominant component direction plus the input signal matrixed by matrix coefficients $w_{i,j}$. The latter coefficients can be derived in various ways, for example:

1. The coefficients $w_{i,j}$ can be determined in the encoder by means of parametric reconstruction of the signals $\hat{y}_l$, $\hat{y}_r$. In other words, in this implementation, the coefficients $w_{i,j}$ aim at faithful reconstruction of the binaural signals $y_l$, $y_r$ that would have been obtained when rendering the original input objects/channels binaurally; in other words, the coefficients $w_{i,j}$ are content driven.

2. The coefficients $w_{i,j}$ can be sent from the encoder to the decoder to represent HRTFs for fixed spatial positions, for example at azimuth angles of +/−45 degrees. In other words, the residual signal is processed to simulate reproduction over two virtual loudspeakers at certain locations. As these coefficients representing HRTFs are transmitted from encoder to decoder, the locations of the virtual speakers can change over time and frequency. If this approach is employed using static virtual speakers to represent the residual signal, the coefficients $w_{i,j}$ do not need transmission from encoder to decoder, and may instead be hard-wired in the decoder. A variation of this approach would consist of a limited set of static positions that are available in the decoder, with their corresponding coefficients $w_{i,j}$, and the selection of which static position is used for processing the residual signal is signaled from encoder to decoder.

The signals $\hat{y}_l$, $\hat{y}_r$ may be subject to a so-called up-mixer, reconstructing more than 2 signals by means of statistical analysis of these signals at the decoder, following by binaural rendering of the resulting up-mixed signals.

The methods described can also be applied in a system in which the transmitted signal Z is a binaural signal. In that particular case, the decoder 60 of FIG. 5 remains as is, while the block labeled 'Generate stereo (LoRo) mix' 44 in FIG. 4 should be replaced by a 'Generate anechoic binaural mix' 43 (FIG. 4) which is the same as the block producing the signal pair Y. Additionally, other forms of mixes can be generated in accordance with requirements.

This approach can be extended with methods to reconstruct one or more FDN input signal(s) from the transmitted stereo mix that consists of a specific subset of objects or channels.

The approach can be extended with multiple dominant components being predicted from the transmitted stereo mix, and being rendered at the decoder side. There is no fundamental limitation of predicting only one dominant component for each time/frequency tile. In particular, the number of dominant components may differ in each time/frequency tile.

INTERPRETATION

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Various aspects of the present invention may be appreciated from the following enumerated example embodiments (EEESs):

EEE 1. A method of encoding channel or object based input audio for playback, the method including the steps of:

(a) initially rendering the channel or object based input audio into an initial output presentation;

(b) determining an estimate of the dominant audio component from the channel or object based input audio and determining a series of dominant audio component weighting factors for mapping the initial output presentation into the dominant audio component;

(c) determining an estimate of the dominant audio component direction or position; and (d) encoding the initial output presentation, the dominant audio component weighting factors, the dominant audio component direction or position as the encoded signal for playback.

EEE 2. The method of EEE 1, further comprising determining an estimate of a residual mix being the initial output presentation less a rendering of either the dominant audio component or the estimate thereof.

EEE 3. The method of EEE 1, further comprising generating an anechoic binaural mix of the channel or object based input audio, and determining an estimate of a residual mix, wherein the estimate of the residual mix is the anechoic binaural mix less a rendering of either the dominant audio component or the estimate thereof.

EEE 4. The method of EEE 2 or 3, further comprising determining a series of residual matrix coefficients for mapping the initial output presentation to the estimate of the residual mix.

EEE 5. The method of any previous EEE wherein said initial output presentation comprises a headphone or loudspeaker presentation.

EEE 6. The method of any previous EEE wherein said channel or object based input audio is time and frequency tiled and said encoding step is repeated for a series of time steps and a series of frequency bands.

EEE 7. The method of any previous EEE wherein said initial output presentation comprises a stereo speaker mix.

EEE 8. A method of decoding an encoded audio signal, the encoded audio signal including:

a first output presentation;

a dominant audio component direction and dominant audio component weighting factors;

the method comprising the steps of:

(a) utilizing the dominant audio component weighting factors and initial output presentation to determine an estimated dominant component;

(b) rendering the estimated dominant component with a binauralization at a spatial location relative to an intended listener in accordance with the dominant audio component direction to form a rendered binauralized estimated dominant component;

(c) reconstructing a residual component estimate from the first output presentation; and (d) combining the rendered binauralized estimated dominant component and the residual component estimate to form an output spatialized audio encoded signal.

EEE 9. The method of EEE 8 wherein said encoded audio signal further includes a series of residual matrix coefficients representing a residual audio signal and said step (c) further comprises:

(c1) applying said residual matrix coefficients to the first output presentation to reconstruct the residual component estimate.

EEE 10 The method of EEE 8, wherein the residual component estimate is reconstructed by subtracting the rendered binauralized estimated dominant component from the first output presentation.

EEE 11. The method of EEE 8 wherein said step (b) includes an initial rotation of the estimated dominant component in accordance with an input headtracking signal indicating the head orientation of an intended listener.

EEE 12. A method for decoding and reproduction of an audio stream for a listener using headphones, the method comprising:

(a) receiving a data stream containing a first audio representation and additional audio transformation data;

(b) receiving head orientation data representing the orientation of the listener;

(c) creating one or more auxiliary signal(s) based on said first audio representation and received transformation data;

(d) creating a second audio representation consisting of a combination of said first audio representation and said auxiliary signal(s), in which one or more of said auxiliary signal(s) have been modified in response to said head orientation data; and (e) outputting the second audio representation as an output audio stream.

EEE 13. A method according to EEE 12, in which the modification of the auxiliary signals consists of a simulation of the acoustic pathway from a sound source position to the ears of the listener.

EEE 14. A method according to EEE 12 or 13, in which said transformation data consists of matrixing coefficients and at least one of: a sound source position or sound source direction.

EEE 15. A method according to any of EEEs 12 to 14, in which the transformation process is applied as a function of time or frequency.

EEE 16. A method according to any of EEEs 12 to 15, in which the auxiliary signals represent at least one dominant component.

EEE 17. A method according to any of EEEs 12 to 16, in which the sound source position or direction received as part of the transformation data is rotated in response to the head orientation data.

EEE 18. A method according to EEE 17, in which the maximum amount of rotation is limited to a value less than 360 degrees in azimuth or elevation.

EEE 19. A method according to any of EEEs 12 to 18, in which the secondary representation is obtained from the first representation by matrixing in a transform or filterbank domain.

EEE 20. A method according to any of EEEs 12 to 19, in which the transformation data further comprises additional matrixing coefficients, and step (d) further comprises modifying the first audio presentation in response to the additional matrixing coefficients prior to combining the first audio presentation and the auxiliary audio signal(s).

EEE 21. An apparatus, comprising one or more devices, configured to perform the method of any one of EEEs 1 to 20.

EEE 22. A computer readable storage medium comprising a program of instructions which, when executed by one or more processors, cause one or more devices to perform the method of any one of EEEs 1 to 20.

The invention claimed is:

1. A system configured to encode channel or object based input audio for playback, the system comprising:

one or more processor; and a computer-readable medium storing instructions which, when executed by the one or more processors, cause the one or more processors to perform operations comprising:

rendering the channel or object based input audio into an initial output presentation;

determining an estimate of a dominant audio component from the channel or object based input audio, the determining including:

determining a series of dominant audio component weighting factors for mapping the initial output presentation into the dominant audio component; and determining the estimate of a dominant audio component based on the dominant audio component weighting factors and the initial output presentation;

determining an estimate of the dominant audio component direction or position; and encoding the initial output presentation, the dominant audio component weighting factors, and at least one of the dominant audio component direction or position as the encoded signal for playback.

2. The system of claim 1, the operations further comprising determining an estimate of a residual mix being the initial output presentation less a rendering of either the dominant audio component or the estimate thereof.

3. The system of claim 2, the operations further comprising determining a series of residual matrix coefficients for mapping the initial output presentation to the estimate of the residual mix.

4. The system of claim 1, the operations further comprising generating an anechoic binaural mix of the channel or object based input audio, and determining an estimate of a residual mix, wherein the estimate of the residual mix is the anechoic binaural mix less a rendering of either the dominant audio component or the estimate thereof.

5. The system of claim 1, wherein said initial output presentation comprises a headphone presentation or loudspeaker presentation.

6. The system claim 1, wherein said channel or object based input audio is time and frequency tiled and said encoding step is repeated for a series of time steps and a series of frequency bands.

7. The system of claim 1, wherein said initial output presentation comprises a stereo speaker mix.

8. A system configured to decode an audio signal, comprising:

one or more processors; and a non-transitory computer-readable medium storing instructions which, when executed by the one or more processors, cause the one or more processors to perform operations comprising:

receiving an encoded audio signal, the encoded audio signal including:

an initial output presentation comprising a stereo down-mix;

a dominant audio component direction; and dominant audio component weighting factors;

determining an estimated dominant component based on the dominant audio component weighting factors and the initial output presentation;

forming a rendered binauralized estimated dominant component, including rendering the estimated dominant component with a binauralization at a spatial location relative to an intended listener in accordance with the dominant audio component direction;

reconstructing a residual component estimate from the initial output presentation; and generating an output spatialized audio signal by combining the rendered binauralized estimated dominant component and the residual component estimate.

9. The system of claim 8, wherein said encoded audio signal further includes a series of residual matrix coefficients representing a residual audio signal and reconstructing the residual component estimate further comprises: applying said residual matrix coefficients to the initial output presentation to reconstruct the residual component estimate.

10. The system of claim 8, wherein the residual component estimate is reconstructed by subtracting the rendered binauralized estimated dominant component from the initial output presentation.

11. The system of claim 8, wherein forming the rendered binauralized estimated dominant component includes an initial rotation of the estimated dominant component in accordance with an input headtracking signal indicating the head orientation of the intended listener.

12. The system of claim 8, wherein the residual component estimate is reconstructed by subtracting the rendered binauralized estimated dominant component from the initial output presentation and wherein forming the rendered binauralized estimated dominant component includes an initial rotation of the estimated dominant component in accordance with an input headtracking signal indicating the head orientation of the intended listener.

13. A non-transitory computer-readable storage medium storing instructions which, when executed by one or more processors, cause one or more devices to perform operations comprising:

rendering channel or object based input audio into an initial output presentation;

determining an estimate of a dominant audio component from the channel or object based input audio, the determining including:

determining a series of dominant audio component weighting factors for mapping the initial output presentation into the dominant audio component; and determining the estimate of a dominant audio component based on the dominant audio component weighting factors and the initial output presentation;

determining an estimate of the dominant audio component direction or position; and encoding the initial output presentation, the dominant audio component weighting factors, and at least one of the dominant audio component direction or position as the encoded signal for playback.

* * * * *